US006712873B2

(12) United States Patent
Bergkvist et al.

(10) Patent No.: US 6,712,873 B2
(45) Date of Patent: Mar. 30, 2004

(54) WARM COMPACTION OF STEEL POWDERS

(75) Inventors: Anders Bergkvist, Oslo (NO); Mikael Dahlberg, Nyhamnsläge (SE)

(73) Assignee: Höganäs AB, Höganäs (SE)

( * ) Notice: Subject to any disclaimer, the term of this patent is extended or adjusted under 35 U.S.C. 154(b) by 3 days.

(21) Appl. No.: 10/207,225

(22) Filed: Jul. 30, 2002

(65) Prior Publication Data

US 2003/0230165 A1 Dec. 18, 2003

(30) Foreign Application Priority Data

Jun. 14, 2002 (SE) ..... 0201825

(51) Int. Cl.[7] ..... B22F 1/00
(52) U.S. Cl. ..... 75/252
(58) Field of Search ..... 75/252

(56) References Cited

U.S. PATENT DOCUMENTS

| | | | |
|---|---|---|---|
| 5,154,881 | A | 10/1992 | Rutz et al. |
| 5,460,641 | A | 10/1995 | Åslund et al. |
| 5,744,433 | A | 4/1998 | Storström et al. |
| 6,140,278 | A | 10/2000 | Thomas et al. |
| 6,334,882 | B1 | 1/2002 | Åslund |
| 6,365,095 | B1 | 4/2002 | Bergkvist |

FOREIGN PATENT DOCUMENTS

| | | |
|---|---|---|
| WO | WO 95/33589 | 12/1995 |
| WO | WO 00/16934 | 3/2000 |
| WO | WO 01/19554 | 3/2001 |
| WO | WO 02/083345 | 10/2002 |

*Primary Examiner*—Ngoclan Mai
(74) *Attorney, Agent, or Firm*—Burns, Doane, Swecker & Mathis, L.L.P.

(57) ABSTRACT

The invention concerns a composition for warm compaction comprising a composition comprising a water-atomised standard stainless steel powder including, in addition to iron and 10–30% by weight of chromium, optional alloying elements and inevitable impurities, 0.8%–2.0% by weight of a warm compaction lubricant.

24 Claims, No Drawings

WARM COMPACTION OF STEEL POWDERS

FIELD OF INVENTION

The present invention concerns steel powder compositions as well as the compacted and sintered bodies obtained thereof. Specifically the invention concerns stainless steel powder compositions for warm compaction.

BACKGROUND ART

Since the start of the industrial use of powder metallurgical processes i.e. the pressing and sintering of metal powders, great efforts have been made in order to enhance the mechanical properties of P/M-components and to improve the tolerances of the finished parts in order to expand the market and achieve the lowest total cost.

Recently much attention has been paid to warm compaction as a promising way of improving the properties of P/M components. The warm compaction process gives the opportunity to increase the density level, i.e. decrease the porosity level in finished parts. The warm compaction process is applicable to most powder/material systems. Normally the warm compaction process leads to higher strength and better dimensional tolerances. A possibility of green machining, i.e. machining in the "as-pressed" state, is also obtained by this process.

Warm compaction is considered to be defined as compaction of a particulate material mostly consisting of metal powder above approximately 100° C. up to approximately 150° C. according to the currently available powder technologies such as Densmix™, Ancorbond™ or Flow-Met™.

A detailed description of the warm compaction process is described in e.g. a paper presented at PM TEC 96 World Congress, Washington, June 1996, which is hereby incorporated by reference. Specific types of lubricants used for warm compaction of iron powders are disclosed in e.g. the U.S. Pat. Nos. 5,154,881 (Rutz) and 5,744,433 (Storström).

Until recently it has been observed that the general advantages with warm compaction have been insignificant as only minor differences in e.g. density and green strength have been demonstrated in the case of stainless steel powders. Major problems encountered when warm compacting stainless steel powders are the high ejection forces and the high internal friction during compaction.

However, as disclosed in the U.S. Pat. No. 6,365,095 (Bergkvist), it was recently found that stainless steel powders may be subjected to warm compaction with good results provided that the stainless steel powder is distinguished by very low oxygen, carbon and silicon levels. The widely used standard qualities having higher levels of these elements could however not be successfully warm compacted i.e. the properties of the warm compacts were not significantly better than the green density of a corresponding body compacted at ambient temperature.

It has now unexpectedly been found that also standard stainless steel powders can be compacted at elevated temperatures with good results. In comparison with the stainless steel powders disclosed in the above US patent the standard stainless powders are generally characterised in a higher amount of oxygen, carbon and silicon. These powders are also easier to produce and accordingly cheaper. According to the present invention it has thus, contrary to the teaching in the SE publication, been found that these standard powders can be compacted to high green densities without the use of excessively high compaction pressures. The high green density is valuable when the product is subsequently sintered as it is not necessary to use high sintering temperatures and accompanying high energy consumption in order to get a high sintered density which is normally necessary in order to get good mechanical properties. Additionally high sintering temperatures induce strains in the material which in turn gives poor dimensional stability.

SUMMARY OF THE INVENTION

In brief the process of preparing high density, warm compacted bodies of a water atomised standard stainless steel powder according to the present invention is based on the discovery that specific amounts of lubricants have to be used in the stainless steel powder composition which is subjected to the compaction at elevated temperature. Minor amounts of selected additives included in the composition contribute to the unexpected finding that standard stainless steels can be successfully compacted.

DETAILED DESCRIPTION OF THE INVENTION Type of powder

Preferably the powders subjected to warm compaction are pre-alloyed, water atomised powders which include, by percent of weight, 10–30% of chromium. The stainless steel powder may also include other elements such as, molybdenum, nickel, manganese, niobium, titanium, vanadium. The amounts of these elements may be 0–5% of molybdenum, 0–22% of nickel, 0–1.5% of manganese, 0–2% of niobium, 0–2% of titanium, 0–2% of vanadium, and at most 1% of inevitable impurities and most preferably 10–20% of chromium, 0–3% of molybdenum, 0.1–0.4% of manganese, 0–0.5% of niobium, 0–0.5% of titanium, 0–0.5% of vanadium and essentially no nickel or alternatively 5–15% of nickel, the balance being iron and unavoidable impurities (normally less than 1% by weight). Examples of stainless steel powders which are suitably used according to the present invention are 316 LHC, 316 LHD, 409 Nb, 410 LHC, 434 LHC. The standard steel powders used according to the present invention generally include more than 0.5% by weight of Si and normally the Si content is 0.7–1.0% by weight. This feature distinguishes standard stainless powders from the stainless powders used for the warm compaction according to the U.S. Pat. No. 6,365,095 (Bergkvist) mentioned above.

AMOUNT OF LUBRICANT

The amount of lubricant in the composition to be compacted is an important factor for the possibility to get a satisfactory result. It has thus been found that the total amount of lubricant should be above 0.8% by weight, preferably at least 1.0% by weight and most preferably at least 1.2% by weight of the total powder composition. As increasing amounts of lubricant decrease the final green density due to the fact that the lubricants normally have much lower density than the metal powder, lubricant amounts above 2.0% by weight are less important. In practice it is believed that the upper limit should be less than 1.8% by weight. A minor amount, such as at least 0.05 and at most 0.4% by weight of the lubricant should preferably be a compound having high oxygen affinity.

TYPE OF LUBRICANT

The lubricant may be of any type as long as it is compatible with the warm compaction process. Examples of such lubricants are disclosed in e.g. the U.S. Pat Nos. 5,154,881 (Rutz) and 5,744,433 (Storström), which are referred to above and which are hereby incorporated by reference. Preliminary results have also shown that lubricants conventionally used for cold compaction, such as EBS, may be used for warm compaction of the standard steel powders according to the present invention although the flow properties of such powder compositions are inferior.

So far however the most promising results have been obtained by using a type of lubricants disclosed in the copending patent application SE02/00762 PCT. These type of lubricants include an amide component which can be represented by the following formula $$D—C_{ma}—B—A—B—C_{mb}—D$$

wherein

D is —H, COR, CNHR, wherein R is a straight or branched aliphatic or aromatic group including 2–21 C atoms C is the group —NH $(CH)_n$CO—

B is amino or carbonyl

A is alkylen having 4–16 C atoms optionally including up to 4 O atoms ma and mb which may be the same of different is an integer 1–10 n is an integer 5–11.

Examples of preferred such amides are:

$CH_3(CH_2)_{16}CO—[HN(CH_2)_{11}CO]_2—HN(CH_2)_{12}NH—[OC(CH_2)_{11}NH]_2—OC(CH_2)_{16}CH_3$ $CH_3(CH_2)_{16}CO—[HN(CH_2)_{11}CO]_2—HN(CH_2)_{12}NH—[OC(CH_2)_{11}NH]_3—OC(CH_2)_{16}CH_3$ $CH_3(CH_2)_{16}CO—[HN(CH_2)_{11}CO]_3—HN(CH_2)_{12}NH—[OC(CH_2)_{11}NH]_3—OCCH_2)_{16}CH_3$ $CH_3(CH_2)_{16}CO—[HN(CH_2)_{11}CO]_3—HN(CH_2)_{12}NH—[OC(CH_2)_{11}NH]_4—OC(CH_2)_{16}CH_3$ $CH_3(CH_2)_{16}CO—[HN(CH_2)_{11}CO]_4—HN(CH_2)_{12}NH—[OC(CH_2)_{11}NH]_4—OC(CH_2)_{16}CH_3$ $CH_3(CH_2)_{16}CO—[HN(CH_2)_{11}CO]_4—HN(CH_2)_{12}NH—[OC(CH_2)_{11}NH]_5—OC(CH_2)_{16}CH_3$ $CH_3(CH_2)_{16}CO—[HN(CH_2)_{11}CO]_5—HN(CH_2)_{12}NH—[OC(CH_2)_{11}NH]_5—OC(CH_2)_{16}CH_3$

As previously mentioned the lubricant should preferably also include a compound having high affinity for oxygen. Examples of such high affinity compounds are alkali metal stearates. Other examples are stearates of alkaline earth metals. The presently most preferred compound being lithium stearate.

Selected Additives

According to a preferred embodiment of the invention minor amounts of selected additives may be included in the composition before the powder composition is subjected to warm compaction. These additives include fatty acids and flow enhancing agents.

The fatty acid may be selected from the group consisting of stearic acid and oleic acid. The amounts of the fatty acid in the composition according to the invention may vary between 0.005 and 0.5, preferably between 0.010 and 0.16 and most preferably between 0.015 and 0.10% of the lubricant composition.

The flow agent may be a material of the type described in the U.S. Pat. No. 5,782,954 (Luk). This material is comprised of nanoparticles of various metals and their oxides such as silicon oxide. Typically, the metal and metal oxide powders have average particle sizes below about 500 nanometers. The silicon oxide flow agents are preferably blended with the iron-based powders in an amount of from about 0.005 to about 2 percent by weight of the resultant powder composition. The preferred silicon oxide flow agents are powders or particles of silicon dioxide having an average particle size below about 40 nanometers. An example of a suitable flow agent is Aerosil.

Warm Compaction

The stainless steel powder including the lubricant and optional additives is subsequently compacted at an elevated temperature. The warm compaction may be performed with a preheated powder, a preheated die or both. The powder could e.g. be preheated to a temperature between 100° C. and 200° C. and the compaction could be performed at a temperature of about 100° C. and 150° C. The compaction is performed in standard compaction equipment with compaction pressures preferably between about 500 and 800 MPa.

Sintering

The obtained green bodies are then sintered in the same way as the standard materials, i.e. at temperatures between 1100° C. and 14000° C., the most pronounced advantages being obtained when the sintering is performed between 1250 and 1325° C. A lower sintering temperature may be used in order to reach a given sintered density by using warm compaction instead of compaction at ambient temperature. Furthermore the sintering is preferably carried out in standard non oxidative atmosphere for periods between 15 and 90, preferably between 20 and 60 minutes. The high densities according to the invention are obtained without the need of recompacting, resintering and/or sintering in inert atmosphere or vacuum.

The invention is illustrated by the following non limiting examples.

EXAMPLES

Example 1

This experiment was carried out with a standard materials 434 LHC, 409 Nb, 316 LHD och 410 LHC which are all available from Hoganas, Belgium and have the compositions indicated in table 1.

TABLE 1

| | % Cr | % Ni | % Mo | % Si | % Mn | % Nb | % C | % O | % Fe |
|---|---|---|---|---|---|---|---|---|---|
| 434 LHC | 16.9 | 0.1 | 1.0 | 0.76 | 0.16 | 0 | 0.016 | 0.22 | Bal |
| 409 Nb | 11.3 | 0.1 | 0 | 1.0 | 0.1 | 0.5 | 0.01 | 0.15 | Bal |
| 316 LHD | 16.9 | 12.8 | 2.3 | 0.8 | 0.1 | 0 | 0.02 | 0.36 | Bal |
| 410 LHC | 11.8 | 0.2 | 0 | 0.8 | 0.1 | 0 | <0.01 | 0.24 | Bal |

Compaction was made on samples of 50 g of these stainless steel powders at 600 and 800 MPa. The warm compaction was performed with a powder temperature and a die temperature of 110° C. The amounts of lubricants are disclosed in the following table 2, wherein CC (cold compaction which is the conventional type of compaction) indicates that the compaction was performed at room temperature (ambient temperature) and WC indicates warm compaction.

TABLE 2

| Sample | Powder | Amount of lubricant | Lubricant composition | Type of compaction |
|---|---|---|---|---|
| $434_{ca}$ | 434 LHC | 0.6* | a | CC |
| $434_{wb}$ | 434 LHC | 0.6* | b | WC |
| $409_{cc}$ | 409 Nb | 1.2 | c | CC |
| $409_{wd}$ | 409 Nb | 1.2 | d | WC |
| $316_{wd}$ | 316 LHD | 1.2 | d | WC |
| $410_{wd}$ | 410 LHC | 1.2 | d | WC |
| $410_{wb}$ | 410 LHC | 1.1 | b | WC |
| $410_{wc}$ | 410 LHC | 1.1 | c | WC |
| $410_{cc}$ | 410 LHC | 1.1 | c | CC |

*not within the scope of the invention

The following lubricants and lubricant compositions were used in the different samples:

a Ethylene bisstearamide (EBS)

b Advawax c EBS +0.3% Li stearate d 1.0% amide oligomer according to SE02/00762 PCT.+ 0.2% Li stearate, 0.05% stearic acid, 0.1% Aerosil The following Table 3 discloses the green densities obtained when the samples were compacted at 600 MPa and 800 MPa, respectively.

TABLE 3

| Sample | Green density ($g/cm^3$) at 600 MPa | Green density ($g/cm^3$) at 800 MPa |
|---|---|---|
| $434_{ca}$ | 6.38 | 6.62 |
| $434_{wb}$ | 6.43* | 6.67* |
| $409_{cc}$ | 6.45 | 6.68 |
| $409_{wd}$ | 6.68 | 6.96 |
| $316_{wd}$ | 6.73 | 7.02 |
| $410_{wd}$ | 6.83 | 7.00 |
| $410_{wb}$ | 6.78 | 7.00 |
| $410_{wc}$ | 6.76** | 6.99** |
| $410_{cc}$ | 6.61 | 6.82 |

*problems during compaction, no sintering possible.
**somewhat reduced flow

The green parts were sintered at 1160° C. in hydrogen atmosphere for 45 min, after which the sintered density was measured (Table 4).

TABLE 4

| Sample | Sintered density ($g/cm^3$) at 600 MPa | Sintered density ($g/cm^3$) at 800 MPa |
|---|---|---|
| $409_{cc}$ | 6.52 | 6.77 |
| $409_{wd}$ | 6.74 | 7.01 |
| $316_{wd}$ | 6.90 | 7.19 |
| $410_{wd}$ | 6.88 | 7.05 |

The results disclosed in table 5 were obtained when the sintering was performed at 1250° C.

TABLE 5

| Sample | Sintered density ($g/cm^3$) at 600 MPa | Sintered density ($g/cm^3$) at 800 MPa |
|---|---|---|
| $409_{cc}$ | 7.09 | 7.21 |
| $409_{wd}$ | 7.22 | 7.38 |
| $316_{wd}$ | 7.09 | 7.33 |
| $410_{wd}$ | 7.22 | 7.34 |
| $410_{wb}$ | 7.15 | 7.31 |

The following table 6 discloses the tensile properties after sintering at 1250° C.

TABLE 6

| Sample | Ultimate tensile strength MPa 600 MPa | Ultimate tensile strength MPa 800 MPa | Elongation (%) 600 MPa | Elongation (%) 800 MPa |
|---|---|---|---|---|
| $409_{cc}$ | 358 | 374 | 17.0 | 15.9 |
| $409_{wd}$ | 372 | 408 | 16.6 | 18.0 |
| $316_{wd}$ | 418 | 465 | 26.1 | 30.0 |
| $410_{wb}$ | 361 | 384 | 16.5 | 15.9 |

The following table 7 discloses the impact energy after sintering at 1250° C.

TABLE 7

| Sample | Impact energy (J) 600 MPa | Impact energy (J) 800 MPa |
|---|---|---|
| $409_{cc}$ | 135 | 161 |
| $409_{wd}$ | 190 | 264 |
| $316_{wd}$ | 125 | 172 |
| $410_{wb}$ | 169 | 191 |

What is claimed is:

1. A composition for warm compaction of a water atomised stainless steel powder including iron and 10–30% by weight of chromium, optional alloying elements and inevitable impurities, and a lubricant, characterised in that the steel powder is a standard steel powder and that the lubricant is present in an amount of 0.8%–2.0% by weight.

2. Composition according to claim 1 wherein the steel powder includes at least 0.5% by weight of silicon.

3. Composition according to claim 2 wherein the steel powder includes 0.7–1.0% by weight of silicon.

4. Composition according to claim 1 wherein the steel powder includes one or more element selected from the group consisting of molybdenum, nickel, manganese, niobium, titanium, vanadium and at most 1.0% by weight of inevitable impurities.

5. Composition according to claim 1 wherein the lubricant is a warm compaction lubricant.

6. Composition according to claim 1 wherein the lubricant is combined with up to 0.4% by weight of a high oxygen affinity compound.

7. Composition according to claim 6 wherein the lubricant includes between about 0.05 and 0.3% by weight of a high oxygen affinity compound.

8. Composition according to claim 6 wherein the high oxygen affinity compound is lithium stearate.

9. Composition according to claim 1, wherein the lubricant in addition to the optional high oxygen affinity compound essentially consists of an amide oligomer lubricant having the formula $$D—C_{ma}—B—A—B—C_{mb}—D,$$

wherein:

D is —H, COR, CNHR, wherein R is a straight or branched aliphatic or aromatic group including 2–21 C atoms, C is the group $NH(CH_2)_nCO$, B is amino or carbonyl, A is alkylene having 4–16 C atoms optionally including up to 4 O atoms, ma and mb which may be the same of different is an integer 1–10, and n is an integer 5–11.

10. Composition according to claim 1 also including a minor amount of an additive selected from the group consisting of fatty acid and flow agent.

11. Composition according to claim 10, wherein fatty acid is selected from the group consisting of stearic acid and oleic acid.

12. Composition according to claim 11, wherein the amount of fatty acid is between 0.005 and 0.5% by weight of the composition.

13. Composition according to claim 10 including as flow agent silicon oxide in an amount between 0.005 and 2% by weight of the composition.

14. Composition for warm compaction according to claim 1 comprising a water-atomised, standard stainless steel powder including, in addition to iron, 10–30% of chromium, wherein the lubricant is a wax.

15. Composition according to claim 2 wherein the steel powder includes one or more element selected from the group consisting of molybdenum, nickel, manganese, niobium, titanium, vanadium and at most 1.0% by weight of inevitable impurities.

16. Composition according to claim 3 wherein the steel powder includes one or more element selected from the group consisting of molybdenum, nickel, manganese, niobium, titanium, vanadium and at most 1.0% by weight of inevitable impurities.

17. Composition according to claim 2 wherein the lubricant is a warm compaction lubricant.

18. Composition according to claim 2 wherein the lubricant is combined with up to 0.4% by weight of a high oxygen affinity compound.

19. Composition according to claim 7 wherein the high oxygen affinity compound is lithium stearate.

20. Composition according to claim 2, wherein the lubricant in addition to the optional high oxygen affinity compound essentially consists of an amide oligomer lubricant having the formula $$D—C_{ma}—B—A—B—C_{mb}—D,$$

wherein:

D is —H, COR, CNHR, wherein R is a straight or branched aliphatic or aromatic group including 2–21 C atoms, C is the group $—NH(CH_2)_nCO—$, B is amino or carbonyl, A is alkylene having 4–16 C atoms optionally including up to 4 O atoms, ma and mb which may be the same of different is an integer 1–10, and n is an integer 5–11.

21. Composition according to claim 2 also including a minor amount of an additive selected from the group consisting of fatty acid and flow agent.

22. Composition for warm compaction according to claim 2 comprising a water-atomised, standard stainless steel powder including, in addition to iron, 10–30% of chromium, wherein the lubricant is a wax.

23. Composition for warm compaction according to claim 14 wherein said wax is EBS.

24. Composition for warm compaction according to claim 22 wherein said wax is EBS.

* * * * *